US007226021B1

(12) United States Patent
Anderson et al.

(10) Patent No.: US 7,226,021 B1
(45) Date of Patent: Jun. 5, 2007

(54) SYSTEM AND METHOD FOR DETECTING RAIL BREAK OR VEHICLE

(75) Inventors: Todd Alan Anderson, Niskayuna, NY (US); Kenneth Brakeley Welles, II, Scotia, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/318,970

(22) Filed: Dec. 27, 2005

(51) Int. Cl.
*B61L 23/04* (2006.01)
*B61L 25/00* (2006.01)
*G01R 31/08* (2006.01)

(52) U.S. Cl. ..... 246/121; 324/522; 246/120; 246/122 R

(58) Field of Classification Search ..... 324/522; 246/120, 121, 122 R
See application file for complete search history.

(56) References Cited

U.S. PATENT DOCUMENTS

| | | | | |
|---|---|---|---|---|
| 4,022,408 A | | 5/1977 | Staples | 246/34 R |
| 4,622,522 A | | 11/1986 | Alt | 333/24 R |
| 4,728,063 A | | 3/1988 | Petit et al. | 246/34 R |
| 4,886,226 A | | 12/1989 | Frielinghaus | 246/121 |
| 5,680,054 A | * | 10/1997 | Gauthier | 324/713 |
| 5,769,364 A | | 6/1998 | Cipollone | 246/34 B |
| 5,868,360 A | * | 2/1999 | Bader et al. | 246/202 |
| 6,102,340 A | * | 8/2000 | Peek et al. | 246/121 |
| 6,779,761 B2 | * | 8/2004 | Holgate | 246/34 R |
| 2003/0038216 A1 | | 2/2003 | Holgate | 246/122 R |
| 2004/0172216 A1 | * | 9/2004 | Davenport et al. | 702/182 |

* cited by examiner

*Primary Examiner*—Andrew H. Hirshfeld
*Assistant Examiner*—John Zhu
(74) *Attorney, Agent, or Firm*—Fletcher Yoder

(57) ABSTRACT

A rail break or vehicle detection system includes a plurality of voltage sources, each coupled to one of the plurality of zones. A plurality of resistors are provided, each coupled in series with one of the plurality of voltage sources. A plurality of current sensors are provided, each coupled to one of the plurality of resistors and adapted to measure a first set of values and second set of values indicative of current flowing through the resistor. At least one control unit is adapted to receive input from the plurality of current sensors and to compare a difference between the second set of values and the first set of values to a predetermined threshold limit to detect presence of a rail vehicle on the block. The control unit is further adapted to switch a polarity of each voltage source.

34 Claims, 3 Drawing Sheets

| | SENSOR | | | | | |
|---|---|---|---|---|---|---|
| TEST | 11 | 13 | 15 | 17 | 19 | |
| 1 | + | + | + | + | + | 52 |
| 2 | + | + | + | + | - | 54 |
| 3 | + | + | + | - | - | 56 |
| 4 | + | + | - | - | - | 58 |
| 5 | + | - | - | - | - | 60 |
| 6 | - | - | - | - | - | 62 |
| 7 | - | - | - | - | + | 64 |
| 8 | - | - | - | + | + | 66 |
| 9 | - | - | + | + | + | 68 |
| 10 | - | + | + | + | + | 70 |

FIG. 2

SYSTEM AND METHOD FOR DETECTING RAIL BREAK OR VEHICLE

BACKGROUND

The present invention relates generally to a rail break or vehicle detection system and, more specifically, to a long-block multi-zone rail break or vehicle detection system, and a method for detecting a rail break and/or vehicle using such a system.

A conventional railway system employs a rail track as a part of a signal transmission path to detect existence of either a train or a rail break in a block section. In such a method, the track is electrically divided into a plurality of sections, each having a predetermined length. Each section forms a part of an electric circuit, and is referred to as a track circuit. A transmitter device and a receiver device are arranged respectively at either ends of the track circuit. The transmitter device transmits a signal for detecting a train or rail break continuously or at variable intervals and the receiver device receives the transmitted signal.

If a train or rail break is not present in the section formed by the track circuit, the receiver receives the signal transmitted by the transmitter. If a train or rail break is present, the receiver receives a modified signal transmitted by the transmitter, because of the change in the electrical circuit formed by the track and break, or track and train. In general, train presence modifies the track circuit through the addition of a shunt resistance from rail to rail. Break presence modifies the circuit through the addition of an increased resistance in the rail. Break or train detection is generally accomplished through a comparison of the signal received with a threshold value.

Conventional track circuits are generally applied to blocks of about 2.5 miles in length for detecting a train. In such a block, a train should exhibit a train shunt resistance of 0.06 ohms or less, and the ballast resistance or the resistance between the independent rails will generally be greater than 3 ohms/1000 feet. As the block length becomes longer, the overall resistance of a track circuit decreases due to the parallel addition of ballast resistance between the rails. Through this addition of parallel current paths, additional current flows through the ballast and ties and proportionally less through the receiver. Thus, the signal to noise ratio of the track circuits with train presence becomes low.

In one example, fiber optic-based track circuits may be employed for longer blocks (for example, greater than 3 miles) for detecting trains and rail breaks. However, cost for implementing the fiber optic based track circuit is relatively higher and durability may be lower. In yet another example, ballast resistance is increased and block length of the track circuit may be increased accordingly. However, maintenance cost for maintaining a relatively high ballast resistance is undesirably high.

An enhanced long block rail break or vehicle detection system and method is desirable.

BRIEF DESCRIPTION

In accordance with one embodiment of the present invention, a method for detecting a rail break in a block of a rail track includes applying a voltage across the block having a plurality of zones via a plurality of voltage sources. A first set of values indicative of current flow is measured. Each first value corresponds to one of the plurality of zones. Polarity of each voltage source is switched. A second set of values indicative of current flow is then measured. Each second value corresponds to one of the plurality of zones. Variation between the first set of values and the second set of values is monitored to detect presence of a rail break in the block.

In accordance with another embodiment of the present invention, a method for detecting presence of a rail vehicle on a block of a rail track includes applying a voltage across the block having a plurality of zones via a plurality of voltage sources. A first set of values indicative of current flow is measured. Each first value corresponds to one of the plurality of zones. Polarity of each voltage source is switched. A second set of values indicative of current flow is then measured. Each second value corresponds to one of the plurality of zones. A difference between the second set of values and the first set of values is compared to a predetermined threshold limit to detect presence of a rail vehicle on the block.

In accordance with another embodiment of the present invention, a system for detecting a rail break in a block of a rail track having a plurality of zone is provided. The system includes a plurality of voltage sources, each coupled to one of the plurality of zones. A plurality of resistors are provided, each coupled in series with one of the plurality of voltage sources. A plurality of current sensors are provided, each coupled to one of the plurality of resistors and adapted to measure a first set of values and second set of values indicative of current flowing through the resistor. At least one control unit is adapted to receive input from the plurality of current sensors and to monitor variation between the first set of values and the second set of values to detect presence of a rail break in the block. The control unit is further adapted to switch polarity of each voltage source.

In accordance with another embodiment of the present invention, a system for detecting a presence of a rail vehicle on a block of a rail track having a plurality of zones is provided. The system includes a plurality of voltage sources, each coupled to one of the plurality of zones. A plurality of resistors are provided, each coupled in series with one of the plurality of voltage sources. A plurality of current sensors are provided, each coupled to one of the plurality of resistors and adapted to measure a first set of values and second set of values indicative of current flowing through the resistor. At least one control unit is adapted to receive input from the plurality of current sensors and to compare a difference between the second set of values and the first set of values to a predetermined threshold limit to detect presence of a rail vehicle on the block. The control unit is further adapted to switch polarity of each voltage source.

DRAWINGS

These and other features, aspects, and advantages of the present invention will become better understood when the following detailed description is read with reference to the accompanying drawings in which like characters represent like parts throughout the drawings, wherein:

FIG. 2 is a table representing sequential switching of polarities of the voltage sources positioned at intervals along a block section of a rail break or vehicle detection system in accordance with aspects of FIG. 1.

DETAILED DESCRIPTION

Figure 1:
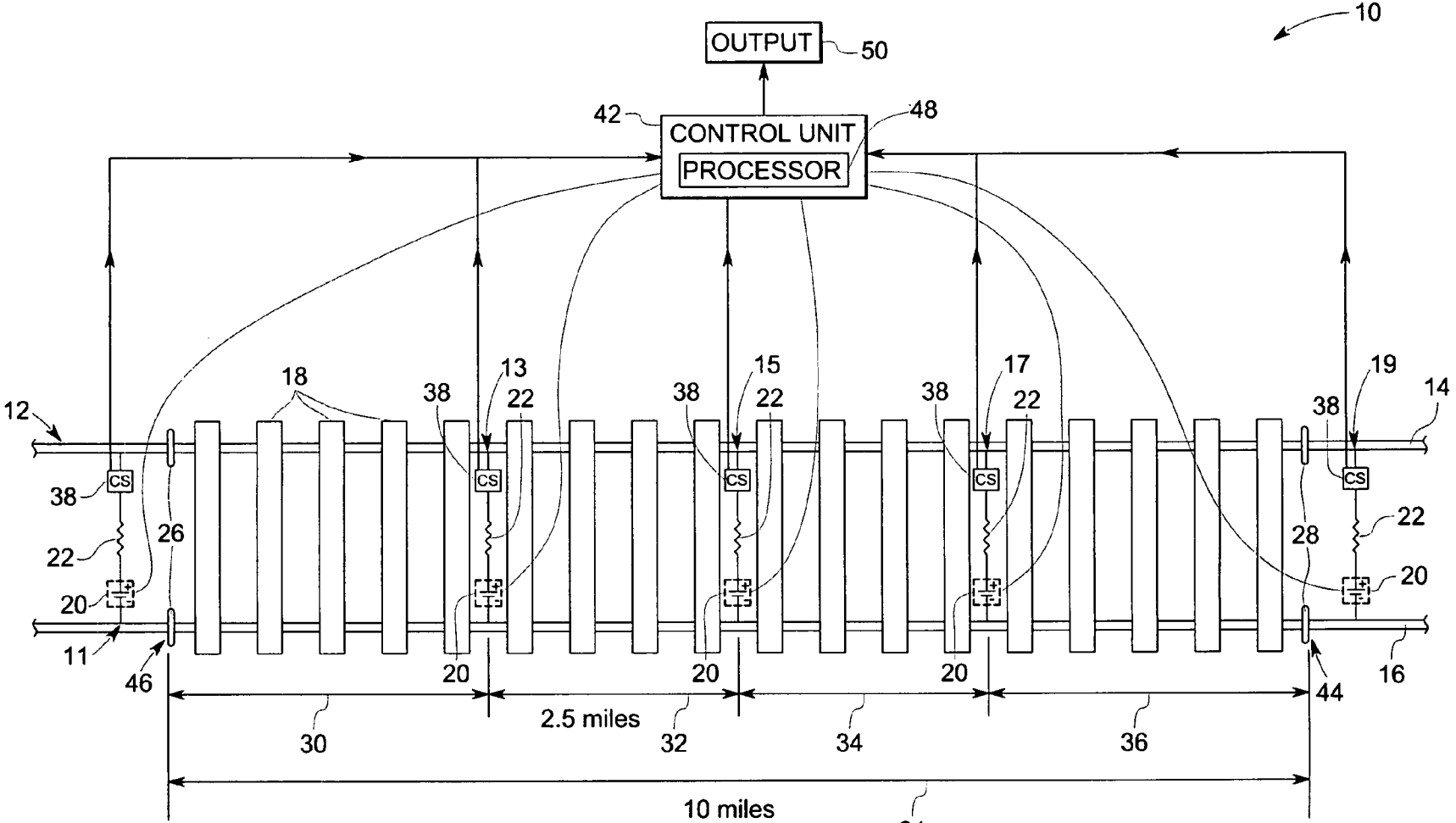
FIG. 1 is a block diagram of a rail break or vehicle detection system in accordance with an exemplary embodiment of the present invention.

Referring generally to FIG. 1, in accordance with several embodiments of the present invention, a rail break or vehicle detection system is illustrated, and represented generally by the reference numeral 10. In the illustrated embodiment, the system 10 includes a railway track 12 having a left rail 14, a right rail 16, and a plurality of ties 18 extending between and generally transverse to the rails 14, 16. The ties 18 are coupled to the rails 14, 16 and provide lateral support to the rails 14, 16 configured to facilitate movement of vehicles, such a trains, trams, testing vehicles, or the like.

In the illustrated embodiment, a plurality of voltage sources 20 and resistors 22 are provided at positions 11, 13, 15, 17, and 19 along a block section 24 formed between two insulated joints 26, 28 of the railway track 10. Each voltage source 20 is coupled in series with the corresponding resistor 22 and is provided between the rails 14, 16. Resultantly, the block section 24 is divided into a plurality of zones 30, 32, 34, and 36. In the illustrated example, the block section 24 of the railway track 12 has a length of about 10 miles. Each zone of the block section has a length of 2.5 miles. Those of ordinary skill in the art, however, will appreciate that the specific length of the block section 24 and the zones 30, 32, 34, and 36 are not an essential feature of the present invention. Similarly, the number of zones, resistors, and voltage sources are not an essential feature of the invention. Examples of voltage sources may include DC voltage source, AC voltage source, static voltage source, or the like. In the illustrated embodiment, the voltage sources 20 are configured to apply voltage across the block section 24 of the railway track 12. Each resistor 22 (e.g. 1 ohm resistor) is configured to receive a current from the voltage applied by the voltage sources 20. The current flowing through each resistor 22 represents total ballast leakage current, when polarities of the voltage sources 20 are the same.

The system 10 further includes a plurality of current sensors 38, each current sensor 38 coupled in series with the corresponding resistor 22. The current sensors 38 are configured to detect the current flowing through the resistors 22. In another exemplary embodiment, the system 10 may include a plurality of voltage sensors, each voltage sensor coupled across the corresponding resistor 22. As known to those skilled in the art, current flowing through the resistor may be determined based on the detected voltage and the resistance of the resistor. A control unit 42 is communicatively coupled to the voltage sources 20, and the current sensors 38. In one embodiment, the control unit 46 is adapted to receive input from the current sensors 38 and monitor variation in current flow through each zone to detect a rail break or presence of a rail vehicle on the block section 24 of the railway track 12. In alternate exemplary embodiments, a plurality of control units may be used to receive input from the current sensors 38 and monitor variation in current flow through each zone to detect a rail break or presence of a rail vehicle on the block section 24 of the railway track 12.

In the illustrated embodiment, the control unit 42 is configured to switch a polarity of the plurality of voltage sources 20 sequentially from a first end 44 towards a second end 46 of the block section 24. In another exemplary embodiment, the control unit 42 is configured to switch a polarity of the plurality of voltage sources 20 sequentially from a second end 46 towards a first end 44 of the block section 24. In yet another exemplary embodiment, the control unit 42 is configured to switch a polarity of the plurality of voltage sources 20 randomly or in any predefined order. When the block section 24 of the railway track 12 is unoccupied by the rail vehicle or a rail break is not detected, a substantial increase in current is detected in a particular zone having voltage sources of mutually opposite polarities located respectively at either ends. For example, if the zone 30 has voltage sources of mutually opposite polarities at its ends at a particular instant, a substantial increase in current is detected in the zone 30, when the block section 24 of the railway track 12 is unoccupied by a rail vehicle or a rail break is not detected. When the block section 24 of the railway track 12 is occupied by wheels of a rail vehicle or a rail break is detected, a negligible increase in current is detected in a particular zone having voltage sources of mutually opposite polarities located respectively at either ends. For example, if the zone 30 has voltage sources of mutually opposite polarities at its ends at a particular instant, a negligible increase in current is detected in the zone 30, when the block section 24 of the railway track 12 is occupied by the rail vehicle or a rail break is detected.

In another exemplary embodiment, the control unit 42 is adapted to detect presence of a rail break or vehicle in the block section 24, when the increase in current of a particular zone having mutually opposite polarities at its ends at a particular instant, is less than a predetermined threshold limit. The predetermined threshold limit is dependent on a variation in a ballast resistance value of the block. The control unit 42 is configured to monitor the variation in the ballast resistance value of the block section 24 and then update the predetermined threshold limit based on the variation in the ballast resistance value. Neural networks, classification algorithms or the like may be used to differentiate between a rail break or a presence of a rail vehicle on the block section 24 of the railway track 12. Differentiation between a break in the track and the presence of a rail vehicle in accordance with aspects of the present invention is described in further detail with respect to subsequent figures.

The control unit 42 includes a processor 48 having hardware circuitry and/or software that facilitates the processing of signals from the current sensors 38 and the voltage sources 20. As will be appreciated by those skilled in the art, the processor 48 may include a microprocessor, a programmable logic controller, a logic module or the like. As discussed previously, in the illustrated embodiment, the control unit 42 is adapted to switch the polarity of the voltage sources 20 sequentially from the first end 44 towards the second end 46 of the block section 24 and vice versa (i.e. from the second end 46 to the first end 44) or randomly. The measurements of the current sensors 38 may be averaged to mitigate systematic and galvanic errors.

In certain embodiments, the control unit 42 may further include a database, and an algorithm implemented as a computer program executed by the control unit computer or the processor 48. The database may be configured to store predefined information about the rail break or vehicle detection system 10 and rail vehicles. The database may also include instruction sets, maps, lookup tables, variables or the like. Such maps, lookup tables, and instruction sets, are operative to correlate characteristics of current flowing through the plurality of zones to detect rail break or presence of a rail vehicle. The database may also be configured to store actual sensed or detected information pertaining to the current, voltage across the block section 28, polarities of the voltage sources 20, ballast resistance values of the block section 28, predetermined threshold limit for the increase in current, rail vehicles, and so forth. The algorithm may facilitate the processing of sensed information pertaining to the current, voltage, and rail vehicle. Any of the above mentioned parameters may be selectively and/or dynamically adapted or altered relative to time. In one example, the control unit 42 is configured to update the above-mentioned predetermined threshold limit based on a ballast resistance value of the block section 24, since the ballast resistance value varies due to changes in environmental conditions, such as humidity, precipitations, or the like. The processor 48 transmits indication signals to an output unit 50 via a wired connection port or a short range wireless link such as infrared protocol, bluetooth protocol, I.E.E.E 802.11 wireless local area network or the like. In general, the indication signal may provide a simple status output, or may be used to activate or set a flag, such as an alert based on the detected current in the plurality of zones of the block section 24.

Referring to FIG. 2, a table representing sequential switching of polarities of the voltage sources 20 located at positions 11, 13, 15, 17, and 19 of the plurality of zones 30, 32, 34, 36 are illustrated in accordance with aspects of FIG. 1. In the illustrated example, 10 tests are conducted for detecting rail break or vehicle presence in the block section 24 of the railway track 12. Initially, all the voltage sensors 20 that apply voltages to the block section 24 have positive polarities as represented in row 52. The polarities of the voltage sources 20 located at positions 19, 17, 15, 13, and 11 are switched (i.e. to negative polarity) sequentially from the first end 44 to the second end 46 as represented by rows 54, 56, 58, 60, and 62. All the voltage sources have negative polarities as represented by row 62. Again, the polarities of the voltage sources 20 are switched (i.e. to positive polarity) sequentially switched from the first end 44 to the second end 46 as represented by rows 64, 66, 68, and 70. The above-mentioned order of switching polarity is merely an example, and in other exemplary embodiments, the order of switching polarity may vary in a predefined order depending on the requirement.

In the illustrated embodiment, for example in the first test, the current sensors 38 measures a first set of values indicative of current flowing through the resistors 22. All the voltage sources have positive polarities. Then in the second test, the polarity of the voltage source located at the position 19 is switched from positive to negative. The current sensors 38 measure a second set of values indicative of current flowing through the resistors 22. At the above-mentioned second test, the zone 36 has voltage sources with mutually opposite polarities located at its either ends. The control unit 42 receives inputs from the plurality of current sensors 38 and monitors variation between the first set of values and second set of values to detect train occupancy or presence of rail break in the block section 24. If a train occupancy or rail break does not exist, a substantial increase in current is detected in the zone 36. If a train occupancy or rail break exist, a negligible increase in current is detected in the zone 36. In one embodiment, if the increase in current (i.e. difference between the first set of values and the second set of values) in the zone 36 is less than a predetermined threshold limit, existence of train occupancy or rail break is detected. The above-mentioned process is repeated for each zone in the block section 24.

The control unit 42 is further configured to average the first set of values and the second set of values of each zone having mutually opposite polarities at its ends to mitigate systematic and galvanic errors. In one example, the current values of the sensors 38 in test 1 represented by the row 52 (i.e. all positive polarities) and test 6 represented by row 62 (i.e. all negative polarities) are averaged to mitigate systematic and galvanic errors. In another example, the current values of the sensors 38 in test 2 represented by row 54 and test 7 represented by row 64 are averaged to mitigate systematic and galvanic errors. Similarly, any number of examples is envisaged.

In accordance with aspects of the present invention, the zone length of each zone of the block section is determined based on the resolution of the current sensors 38. As discussed previously, when the block section of the railway track 12 is occupied by wheels of a rail vehicle or a rail break is detected, a negligible increase in current is detected in a particular zone having voltage sources of mutually opposite polarities located respectively at either ends. The current sensor in accordance with aspects of the present invention, is capable of resolving changes in current measurements, when a rail break or train presence is detected in the block section. The greater the zone length, the changes in the current measurements becomes smaller.

Figure 3:
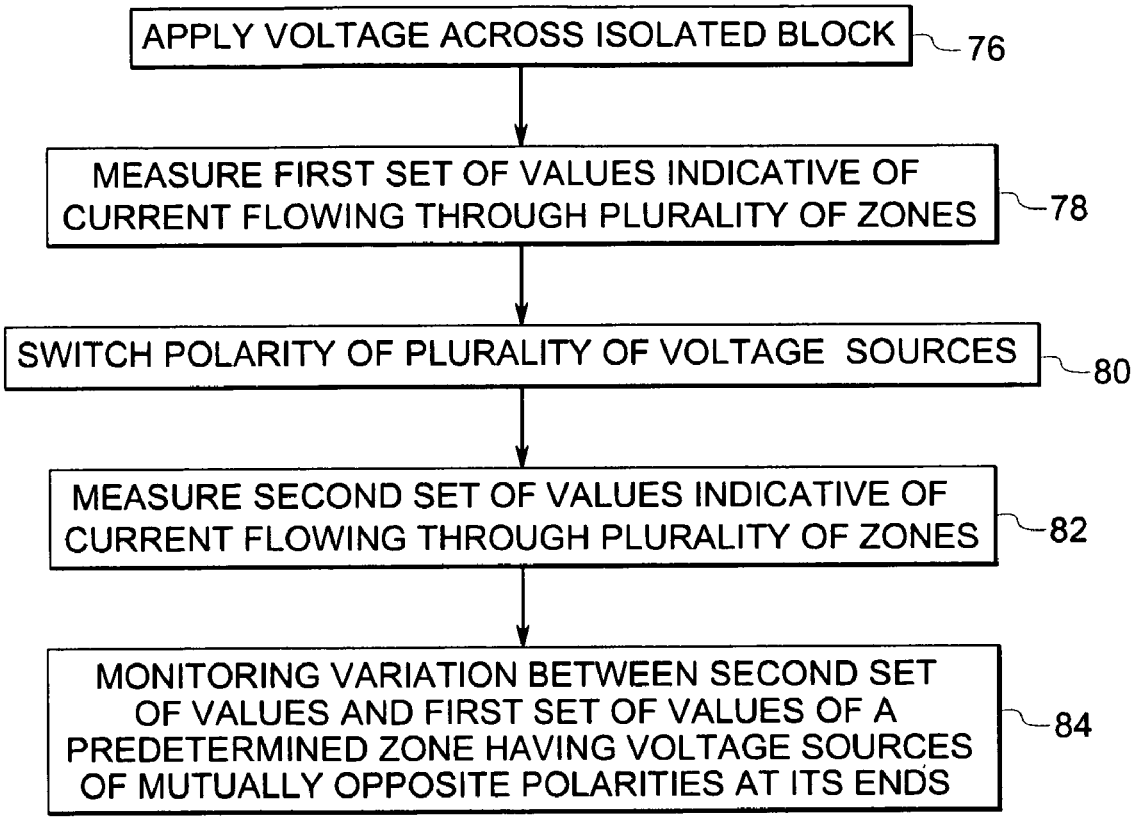
FIG. 3 is a flow chart illustrating exemplary processes of detecting rail break or vehicle in accordance with an exemplary embodiment of the present invention.

FIG. 3 is a flow chart illustrating a method of detecting rail break or vehicle in accordance with an exemplary embodiment of the present invention. The method includes applying a voltage across the block section 24 of the railway track 12 via a plurality of voltage sources 20 as represented by step 76. Each resistor 22 coupled in series with the corresponding voltage source 20, receives a current from the voltage applied by the voltage sources 20. The current flowing through each resistor 22 represents total ballast leakage current, when polarities of the voltage sources 20 are the same. The current sensors 38 detect the current flowing through the resistors 22. Initially, the current sensors 38 measures a first set of values indicative of current flowing through each zone as represented by step 78.

The control unit 46 receives input from the current sensors 38 and monitors variation of the current flow through each zone to detect a rail break or presence of a rail vehicle on the block section 24 of the railway track 12. In the illustrated embodiment, the control unit 42 switches a polarity of the plurality of voltage sources 20. In one embodiment, the control unit 42 switches a polarity of the plurality of voltage sources sequentially from a first end 44 towards a second end 46 of the block section 24 as represented by step 80. In another exemplary embodiment, the control unit 42 switches a polarity of the plurality of voltage sources 20 sequentially from a second end 46 towards a first end 44 of the block section 24. In yet another embodiment, the control unit 42 is configured to switch a polarity of the plurality of voltage sources 20 randomly or in a predefined order in the block section 24. Then the current sensors measures a second set of values indicative of current flowing through the resistors 22 as represented by step 82.

The control unit 42 receives inputs from the plurality of current sensors 38 and monitors variation between the first set of values and second set of values to detect train occupancy or presence of rail break in the block section as represented by step 84. If a train occupancy or rail break does not exist, a substantial increase in current is detected in the zone having voltage sources with mutually opposite polarities at its ends. If a train occupancy or rail break exist, a negligible increase in current is detected in the zone having voltage sources with mutually opposite polarities at its ends. In one embodiment, if the increase in current (i.e. difference between the first set of values and the second set of values) in the zone is less than a predetermined threshold limit, existence of train occupancy or rail break is detected. The above-mentioned process is repeated for each zone in the block section. The measurements of the current sensors 38 are averaged to mitigate systematic and galvanic errors.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method for detecting a rail break in a block of a rail track, comprising:

applying a voltage across the block having a plurality of zones via a plurality of voltage sources;

measuring a first set of values indicative of current flow, each of which corresponds to one of the plurality of zones;

switching polarity of each voltage source;

measuring a second set of values indicative of current flow, each of which corresponds to one of the plurality of zones; and monitoring variation between the first set of values and the second set of values to detect presence of a rail break in the block.

2. The method of claim 1, comprising measuring the first set of values and the second set of values indicative of current flowing through a plurality of resistors, each of which is coupled in series to the corresponding voltage source.

3. The method of claim 2, comprising measuring the first set of values and the second set of values via a plurality of current sensors.

4. The method of claim 2, further comprising monitoring variation between the first set of values and the second set of values indicative of current flowing through the plurality of resistors to detect presence of a rail vehicle on the block.

5. The method of claim 1, comprising switching a polarity of each voltage source sequentially from a first end to a second end of the block.

6. The method of claim 1, comprising switching a polarity of each voltage source in a predefined order.

7. The method of claim 1, further comprising detecting a rail break when a difference between the second set of values and the first set of values indicative of current flowing through the plurality of resistors is less than a predetermined threshold limit.

8. The method of claim 7, further comprising updating the predetermined threshold limit based on variation in a ballast resistance value of the block.

9. The method of claim 1, further comprising averaging the first set of values and the second set of values to mitigate systematic and galvanic errors.

10. A method for detecting presence of a rail vehicle on a block of a rail track, comprising:

applying a voltage across the block having a plurality of zones via a plurality of voltage sources;

measuring a first set of values indicative of current flow, each of which corresponds to one of the plurality of zones;

switching a polarity of each voltage source;

measuring a second set of values indicative of current flow, each of which corresponds to one of the plurality of zones; and comparing a difference between the second set of values and the first set of values to a predetermined threshold limit to detect presence of a rail vehicle on the block.

11. The method of claim 10, comprising measuring the first set of values and the second set of values indicative of current flowing through a plurality of resistors, each of which is coupled in series to the corresponding voltage source.

12. The method of claim 11, comprising measuring the first set of values and the second set of values via a plurality of current sensors.

13. The method of claim 11, comprising detecting presence of a rail vehicle on the block when the difference between the second set of values and the first set of values indicative of current flowing through the plurality of resistors is less than the predetermined threshold limit.

14. The method of claim 11, further comprising detecting a rail break in the block when the difference between the second set of values and the first set of values indicative of current flowing through the plurality of resistors is less than the predetermined threshold limit.

15. The method of claim 11, further comprising updating the predetermined threshold limit based on variation in a ballast resistance value of the block.

16. The method of claim 10, comprising switching a polarity of each voltage source sequentially from a first end to a second end of the block.

17. The method of claim 10, comprising switching a polarity of each voltage source in a predefined order.

18. The method of claim 10, further comprising averaging the first set of values and the second set of values to mitigate systematic and galvanic errors.

19. A system for detecting a rail break in a block of a rail track, the block of the rail track comprising a plurality of zones, the system comprising:

a plurality of voltage sources, each coupled to one of the plurality of zones;

a plurality of resistors, each coupled in series with one of the plurality of voltage sources;

a plurality of current sensors, each coupled to one of the plurality of resistors and adapted to measure a first set of values and second set of values indicative of current flowing through the resistor; and at least one control unit adapted to receive input from the plurality of current sensors and to monitor variation between the first set of values and the second set of values to detect presence of a rail break in the block, the control unit being further adapted to switch a polarity of each voltage source.

20. The system of claim 19, wherein the control unit is adapted to receive input from the plurality of current sensors and to monitor variation between the first set of values and the second set of values indicative of current flowing through the plurality of resistors to detect presence of a rail vehicle on the block.

21. The system of claim 19, wherein the control unit is configured average the first set of values and the second set of values to mitigate systematic and galvanic errors.

22. The system of claim 19, wherein the control unit is configured to detect a rail break when the difference between the second set of values and the first set of values is less than a predetermined threshold limit.

23. The system of claim 22, wherein the control unit is configured to update the predetermined threshold limit based on variation in a ballast resistance value of the block.

24. The system of claim 19, wherein the control unit is configured to switch a polarity of each voltage source sequentially from a first end to a second end of the block.

25. The system of claim 19, wherein the control unit is configured to switch a polarity of each voltage source in a predefined order.

26. The system of claim 19, wherein a length of each zone of the block is determined based on the resolution of the current sensor.

27. A system for detecting a presence of a rail vehicle on a block of a rail track, the block of the rail track comprising a plurality of zones, the system comprising:

a plurality of voltage sources, each coupled to one of the plurality of zones;

a plurality of resistors, each coupled in series with one of the plurality of voltage sources;

a plurality of current sensors, each coupled to one of the plurality of resistors and adapted to measure a first set of values and second set of values indicative of current flowing through the resistor; and at least one control unit adapted to receive input from the plurality of current sensors and to compare a difference between the second set of values and the first set of values to a predetermined threshold limit to detect presence of a rail vehicle on the block, the control unit being further adapted to switch a polarity of each voltage source.

28. The system of claim 27, wherein the control unit is adapted to receive input from the plurality of current sensors and to compare a difference between the second set of values and the first set of values indicative of current flowing through the plurality of resistors to the predetermined threshold limit to detect rail break in the block.

29. The system of claim 28, wherein the control unit is adapted to detect a rail break in the block when the difference between the second set of values and the first set of values indicative of current flowing through the plurality of resistors is less than the predetermined threshold limit.

30. The system of claim 27, wherein the control unit is configured to average the first set of values and the second set of values to mitigate systematic and galvanic errors.

31. The system of claim 27, wherein the control unit is configured to detect presence of a rail vehicle on the block when the difference between the second set of values and the first set of values indicative of current flowing through the plurality of resistors is less than the predetermined threshold limit.

32. The system of claim 27, wherein the control unit is configured to update the predetermined threshold limit based on variation in a ballast resistance value of the block.

33. The system of claim 27, wherein the control unit is configured to switch a polarity of each voltage source sequentially from a first end to a second end of the block.

34. The system of claim 27, wherein the control unit is configured to switch a polarity of each voltage source in a predefined order.

* * * * *